US007396240B2

(12) United States Patent
Frederiksen et al.

(10) Patent No.: US 7,396,240 B2
(45) Date of Patent: Jul. 8, 2008

(54) ELECTRICAL CONNECTOR WITH A LOCKING MECHANISM

(75) Inventors: Stephen S. Frederiksen, Dearborn Heights, MI (US); Ping Chen, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 52 days.

(21) Appl. No.: 11/398,480

(22) Filed: Apr. 5, 2006

(65) Prior Publication Data

US 2007/0238336 A1 Oct. 11, 2007

(51) Int. Cl.
*H01R 13/52* (2006.01)

(52) U.S. Cl. ..... 439/157

(58) Field of Classification Search ..... 439/157, 439/372

See application file for complete search history.

(56) References Cited

U.S. PATENT DOCUMENTS 5,135,408 A * 8/1992 Suzuki ..... 439/310
5,295,602 A 3/1994 Swanson
5,344,194 A 9/1994 Hatagishi et al.
5,603,624 A 2/1997 Taguchi et al.
5,609,494 A * 3/1997 Yamaguchi et al. ..... 439/157
5,695,349 A * 12/1997 Taguchi et al. ..... 439/157
5,823,809 A * 10/1998 Wakata ..... 439/157
6,012,933 A * 1/2000 Katsuma ..... 439/157
6,058,579 A 5/2000 Brocklesby et al.
6,174,179 B1 * 1/2001 Okabe ..... 439/157
6,312,273 B1 * 11/2001 Hasegawa et al. ..... 439/157
6,328,582 B1 * 12/2001 Fukamachi ..... 439/157
6,517,364 B2 * 2/2003 Muramatsu et al. ..... 439/157
6,623,287 B2 * 9/2003 Hatagishi et al. ..... 439/157
6,644,992 B2 11/2003 Maegawa
6,692,274 B2 * 2/2004 Maegawa ..... 439/157
6,755,674 B2 6/2004 Fujii et al.
6,881,081 B2 * 4/2005 Gundermann et al. ..... 439/157
7,044,758 B2 * 5/2006 Deno et al. ..... 439/157
7,052,294 B1 * 5/2006 Osada ..... 439/157
7,137,835 B2 * 11/2006 Shiga ..... 439/157
7,189,086 B2 * 3/2007 Fukatsu et al. ..... 439/157

(Continued)

OTHER PUBLICATIONS

International Search Report for International Application No. PCT/US2007/008455, mailed on Sep. 19, 2007 (3 pages).

(Continued)

*Primary Examiner*—Gary F. Paumen
(74) *Attorney, Agent, or Firm*—Osha Liang LLP

(57) ABSTRACT

An electrical connector includes a housing and a lever supported pivotally on at least one pivot disposed on the housing. The lever rotates on the pivot within a range from a pre-engagement position to a final engagement position. The lever also has a recess configured to fit a boss disposed on a mating connector therein in accordance with rotational movement of the lever. Further, the lever includes a locking portion disposed on a beam thereof. The locking portion includes a base portion extending downward from the beam, a latching arm extending from the base portion in a direction substantially tangent to the rotational movement; and a latching detent disposed in proximity of a free end of the latching arm. The latching detent is configured to engage with the engaging portion of the housing at the second position, and thereby rotational movement of the lever is restrained at the final engagement position.

18 Claims, 14 Drawing Sheets

U.S. PATENT DOCUMENTS

| | | | | |
|---|---|---|---|---|
| 7,201,591 | B2 * | 4/2007 | Fujii | 439/157 |
| 2002/0031928 | A1 * | 3/2002 | Gundermann et al. | 439/157 |
| 2003/0054681 | A1 * | 3/2003 | Hatagishi et al. | 439/157 |
| 2004/0192090 | A1 * | 9/2004 | Flowers et al. | 439/157 |
| 2006/0051994 | A1 * | 3/2006 | Fujii | 439/157 |
| 2006/0205254 | A1 * | 9/2006 | Foltz et al. | 439/157 |
| 2006/0211286 | A1 * | 9/2006 | Shuey | 439/157 |
| 2007/0197071 | A1 * | 8/2007 | Patterson | 439/157 |

OTHER PUBLICATIONS

Written Opinion of the International Searching Authority for International Application No. PCT/US2007/008455, mailed on Sep. 19, 2007 (5 pages).

* cited by examiner

ELECTRICAL CONNECTOR WITH A LOCKING MECHANISM

BACKGROUND OF INVENTION

1. Field of the Invention

The invention relates generally to electrical connectors, and particularly to an electrical connector with a locking mechanism that assure a combination with a mating electrical connector.

2. Background Art

An electrical connector is a core component used in many electronic systems to electrically connect wiring harnesses. In recent years, electronic systems have grown increasingly complicated. As a consequence, the number of electrical connectors used in some electronic systems has increased, along with the number of wiring harnesses. Some relatively large connectors have also been developed, which may be provided with several dozen terminals or poles. Such connectors may typically include sub housings or sub connectors corresponding to terminals of various types, such as optical fibers and electrical wires for communication and for power.

Connectors are typically manufactured by a connector manufacturer, and thereafter supplied to a harness assembler to attach wiring harnesses thereto. In a process of assembling a female connector, the terminals disposed at an end of the wiring harnesses may be inserted into a housing from a rear side of the housing. The female connector is typically provided with detents, which may be referred to as housing lances, within the housing thereof. When the terminals of the wiring harnesses are inserted into the housing, a portion of the housing lances may be moved upward due to interference with the terminals, and the lances may thereafter "snap" back to engage with notches of the terminals. The TPA (Terminal Position Assurance) member is then inserted into the housing, and bridges a gap in the housing to restrict undesirable movement of the housing lances. For example, the TPA member is inserted into the housing from a front side surface of the housing, and thereby the TPA member bridges the gap, restricting the movement of the lances. The resulting female connector, as is a final product, can be combined with a mating connector, i.e., a male connector. In addition, larger connectors typically require a greater force to combine with the mating connector. Accordingly, the larger connectors are generally provided with an insertion-assist mechanism, such as a lever mechanism, in order to reduce a necessary insertion force. The insertion-assist mechanism typically doubles as a connector locking mechanism to assure a reliable connection between connectors. A lever-typed locking mechanism may adopt a snap-latch design such that a latching detent engages with a latching flange.

While the female connector to which the wiring harnesses are attached is conveyed to the next process, and with a lever at a pre-engagement position, the connector locking mechanism cannot avoid interference with the attached wiring harnesses. Accordingly, the lever locking mechanism may be subject to an excessive force. Over a period of time, the lever locking mechanism eventually becomes deformed, such that the locking mechanism ceases to function properly. Thus, even a slight force applied to the lever may undesirably cause disengagement of a latching detent and a latching flange, thereby resulting in disconnection of the complementary connectors due to rotational movement of the lever.

SUMMARY OF INVENTION

According to one aspect of the invention an electrical connector includes a housing and a lever supported pivotally on at least one pivot disposed on the housing. The lever rotates on the pivot within a range from a pre-engagement position to a final engagement position. The lever also has a recess configured to fit a boss disposed on a mating connector therein in accordance with rotational movement of the lever. Further, the lever includes a locking portion disposed on a beam thereof. The locking portion includes a base portion extending downward from the beam, a latching arm extending from the base portion in a direction substantially tangent to the rotational movement; and a latching detent disposed in proximity of a free end of the latching arm. The latching detent is configured to engage with the engaging portion of the housing at the second position, and thereby rotational movement of the lever is restrained at the final engagement position.

Other aspects and advantages of the invention will be apparent from the following description and the appended claims.

DETAILED DESCRIPTION

Figure 1:
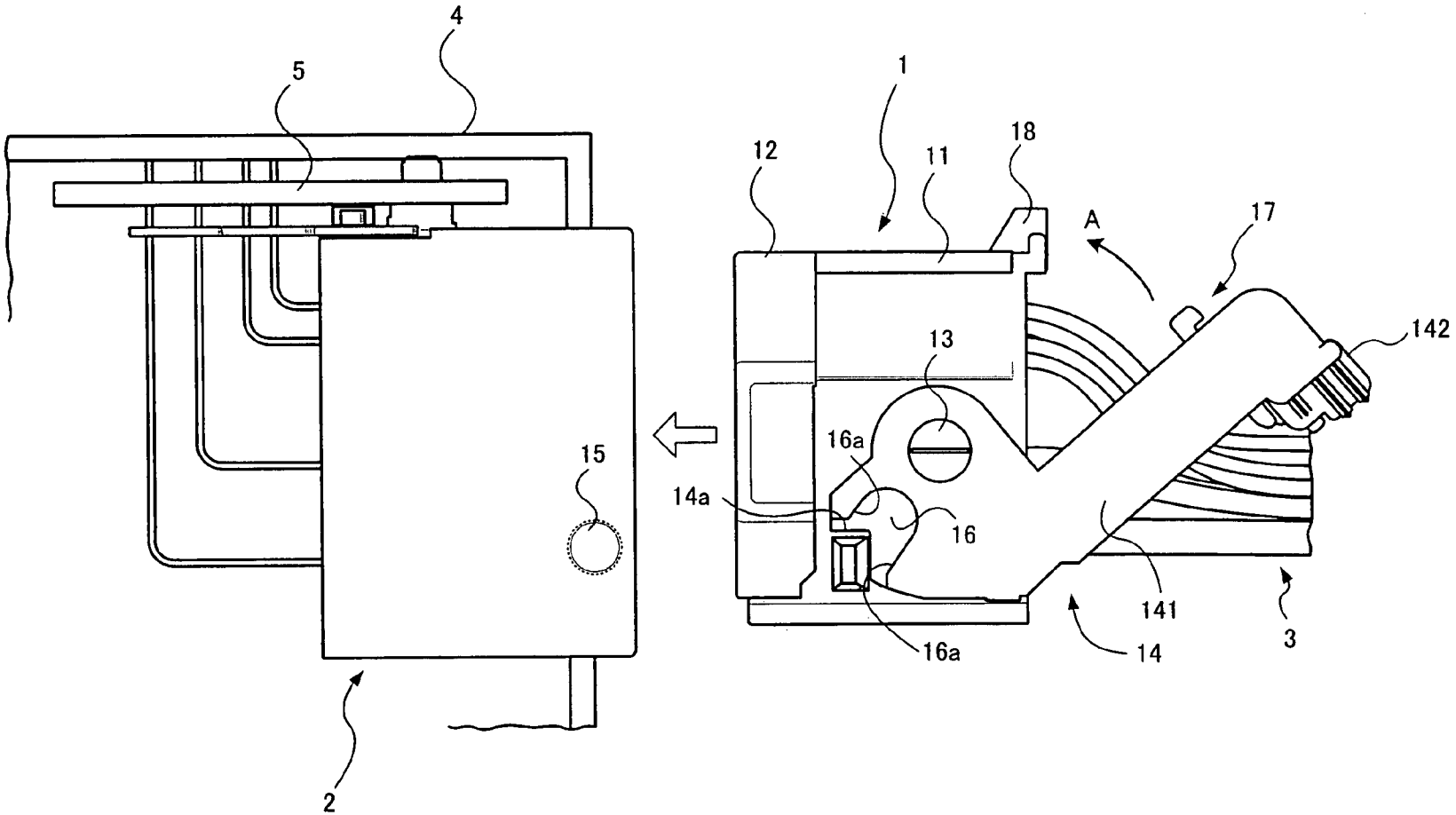
FIG. 1 is a diagram showing that an electrical connector with a connector locking mechanism is about to combining with a mating connector.

FIG. 1 illustrates a female connector according to an embodiment of the present invention. The female connector 1 includes wiring harness 3, which is inserted from a rear surface of the female connector 1. The female connector 1 is about to be connected with a male connector 2 that is mounted on a printed circuit board 5 disposed within a casing 4. The female connector 1 also includes a TPA member 12 disposed at a front surface thereof. Cylindrical protrusions 13 are disposed on both side surfaces of the housing 11, and an roughly inverted-U-shaped lever 14 is pivotally supported by the protrusions 13. The lever 14 stops at a pre-engagement position as shown in FIG. 1. The lever 14 has an arcuate recess 16 configured to fit about a cylindrical boss 15 disposed on an inner surface of a housing of the male connector 2. In connecting mating connectors 1 and 2, the boss 15 comes into contact with a guide portion 16*a* of the recess 16. Subsequently, by way of rotation of the lever 14 in a direction of arrow A, the boss 15 is completely fitted into the recess 16, so as to combine the female connector 1 with the male connector 2. The lever 14 includes two arms 141 and a beam 142 supported by the two arms 141. A lever locking portion 17 made of, for example, a resin material, which has some flexibility, is supported in proximity to the middle of the beam 142. The lever locking portion 17 elastically supports a latching detent as will be described later. The lever locking portion 17 can be engaged with an engaging portion 18 disposed on a corresponding portion of the housing 11 at an final engagement position, restricting rotational movement of the lever 14. Thus, the fit of the boss 15 into the recess 16 is maintained, and, as a consequence, the connection between the complementary connectors 1 and 2 is assured.

Figure 2:
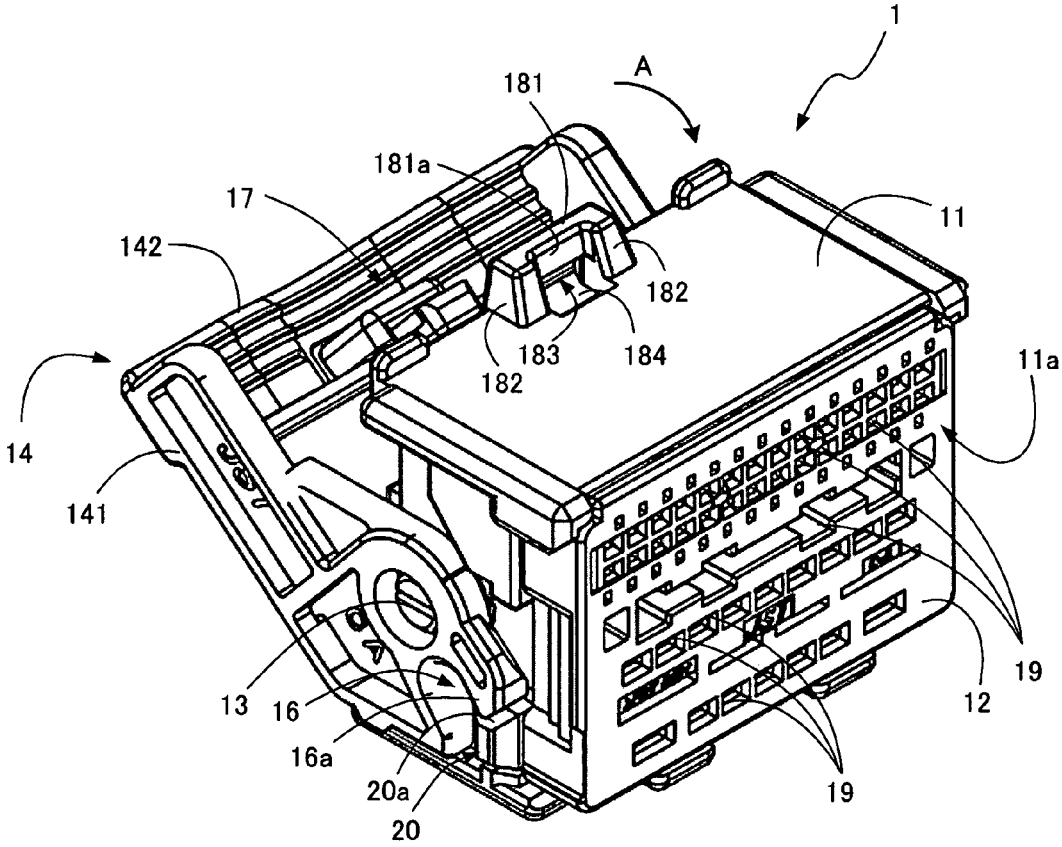
FIG. 2 illustrates a perspective view of a connector with a lever when the lever is positioned at a provisional position according to an embodiment of the invention.
Figure 3:
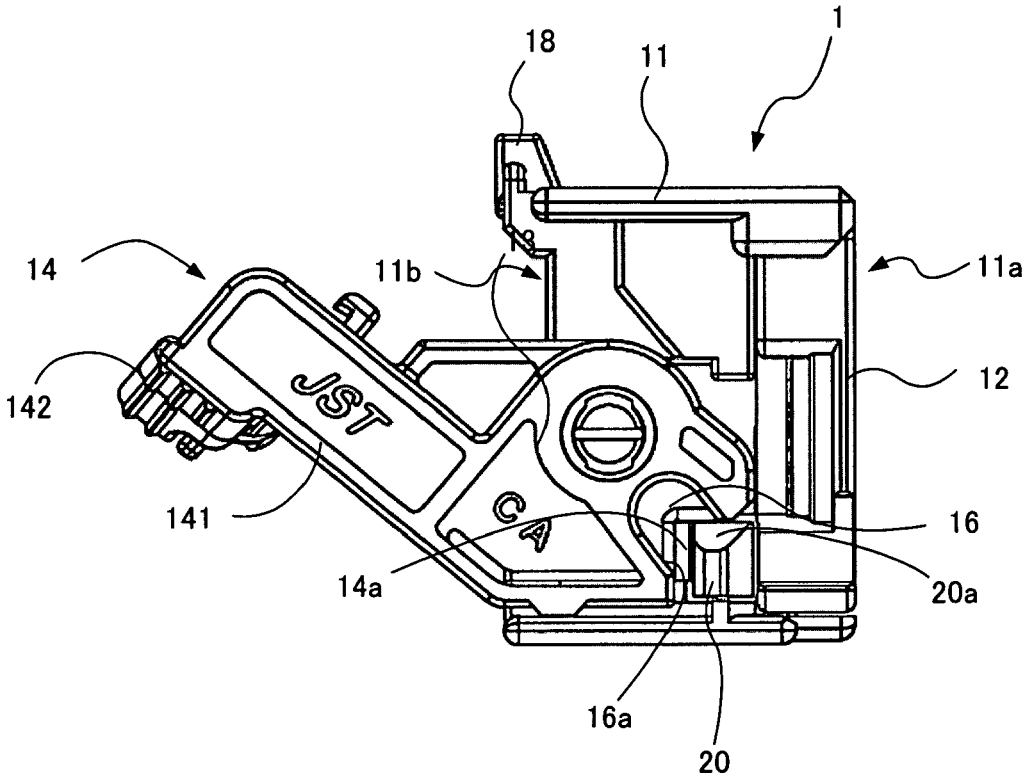
FIG. 3 illustrates a left side view of the connector show in FIG. 2.
Figure 4:
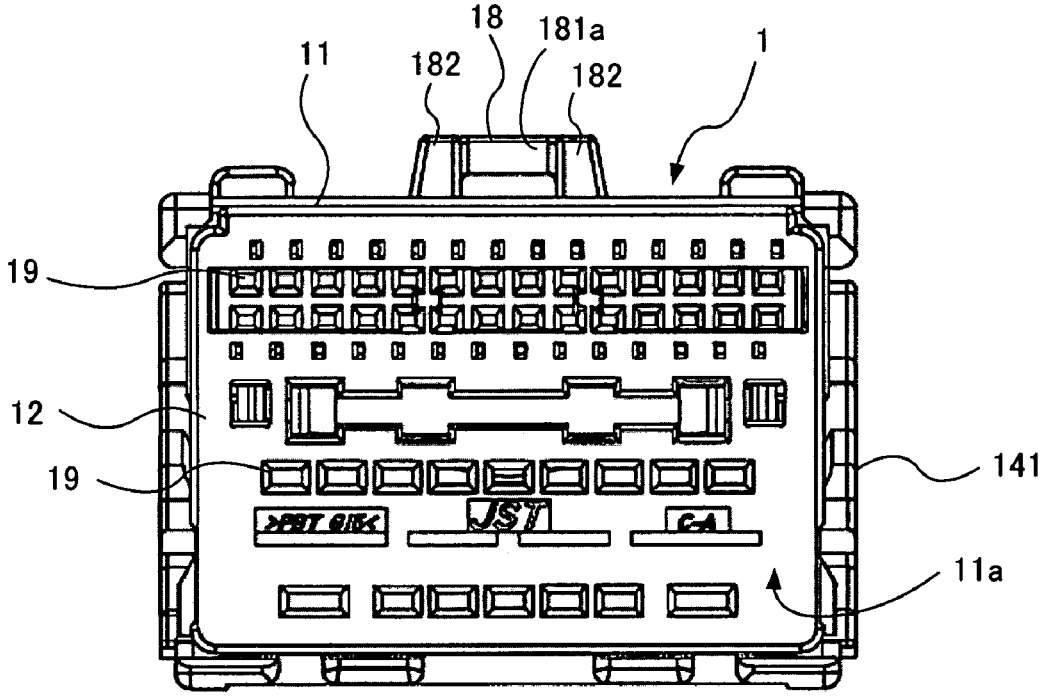
FIG. 4 illustrates a front view of the connector show in FIG. 2.
Figure 5:
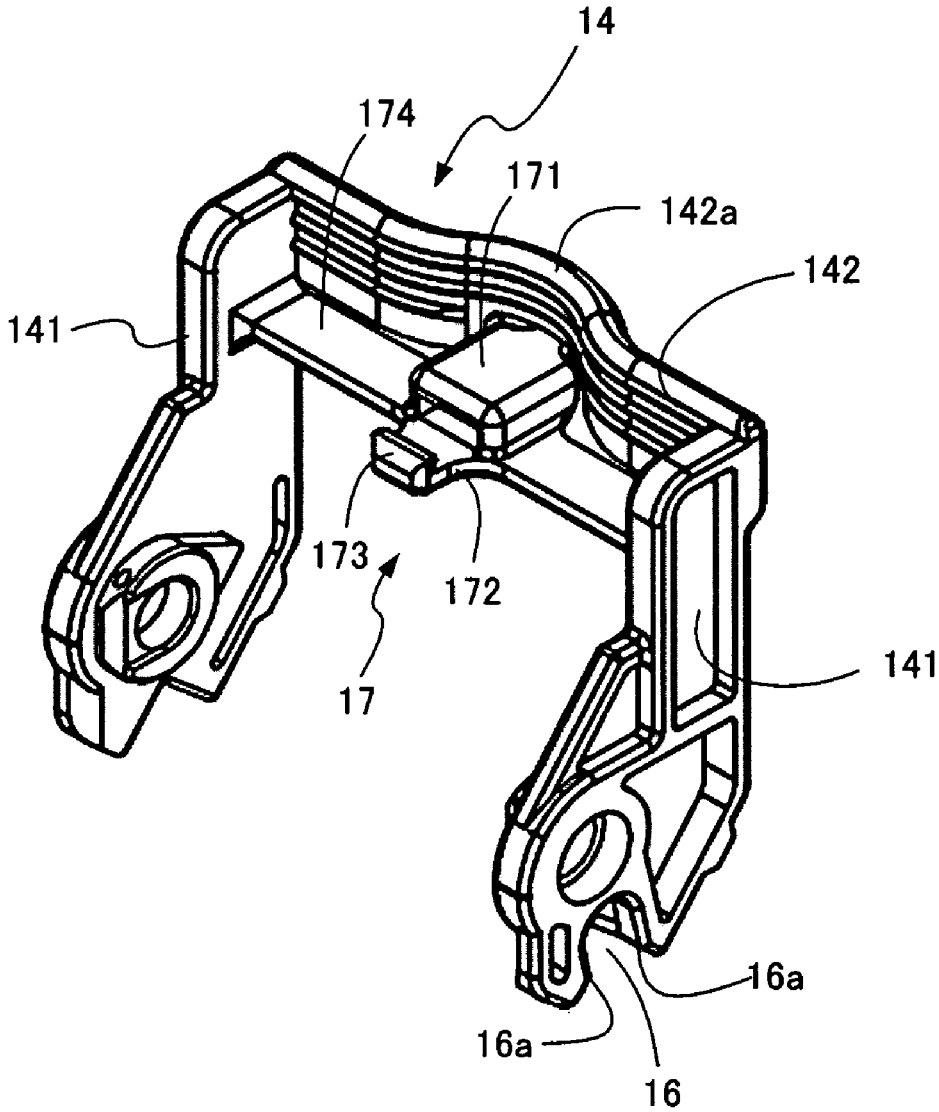
FIG. 5 illustrates a perspective view of a lever of the connector according to an embodiment of the invention.
Figure 6:
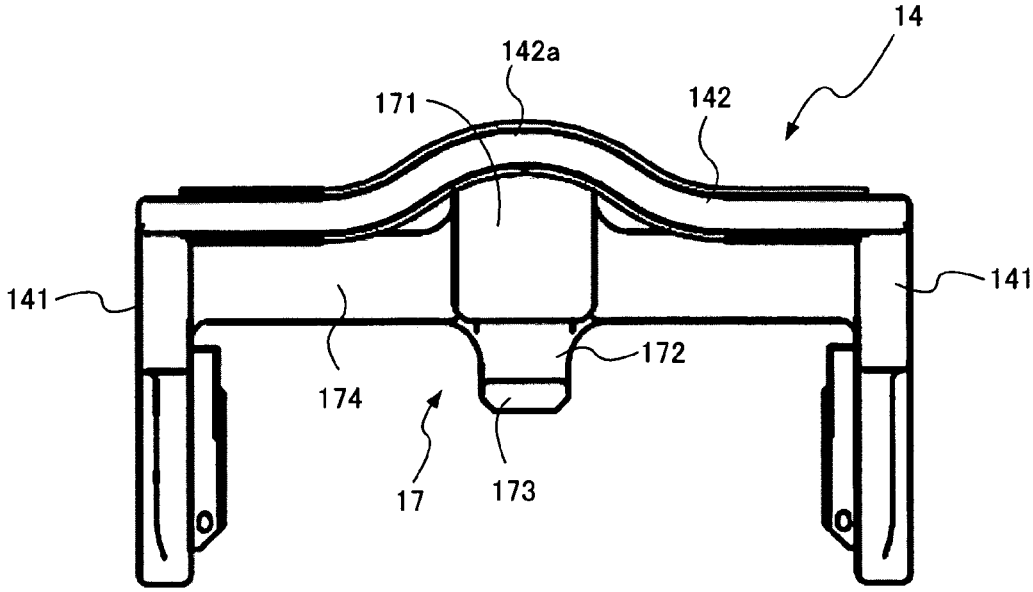
FIG. 6 illustrates a plan view of the lever shown in FIG. 5.
Figure 7:
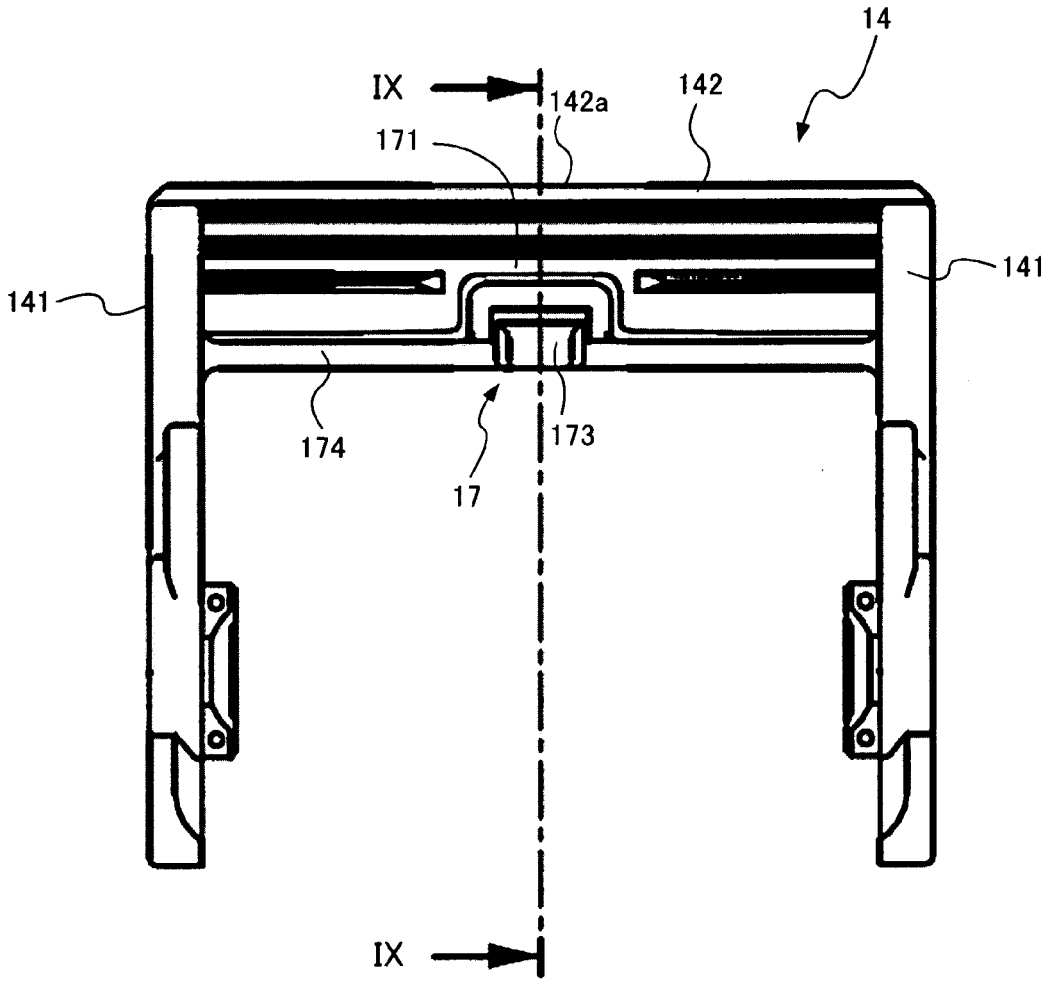
FIG. 7 illustrates a front view of the lever shown in FIG. 5
Figure 8:
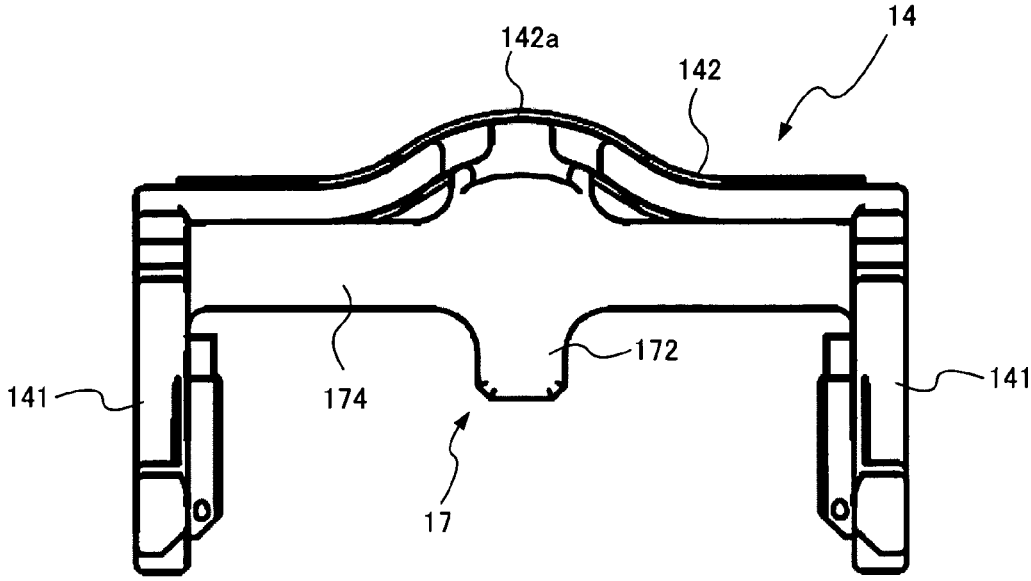
FIG. 8 illustrates a bottom view of the lever shown in FIG. 5.
Figure 9:
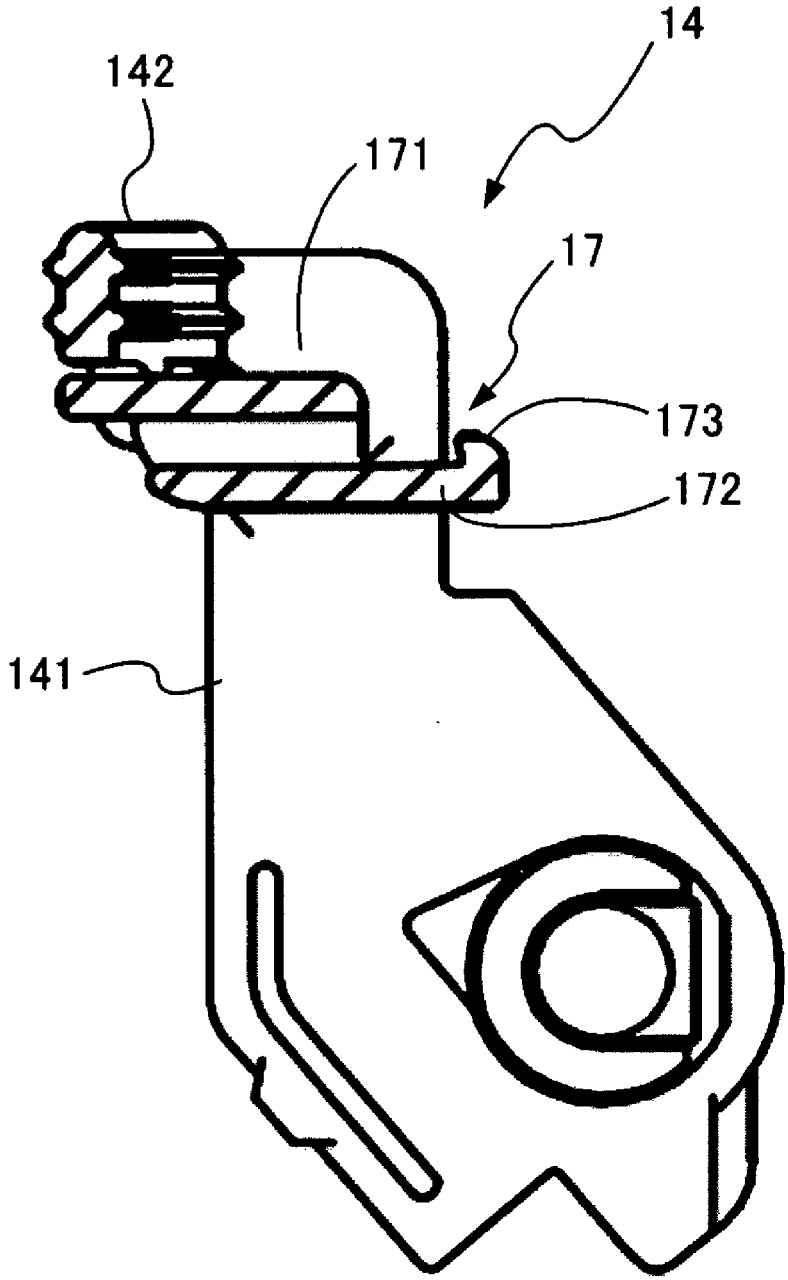
FIG. 9 illustrates a cross-sectional view of the lever long the IX-IX line of FIG. 7.

FIGS. 2-4 illustrate an electrical connector according to one embodiment of the invention. Referring to FIG. 2, a female connector 1 is shown as including a female housing 11 with a lever-type connector locking mechanism. The connector 1 is typically manufactured by a connector manufacturer, and thereafter supplied to a harness assembler to attach wiring harnesses thereto. The connector 1 can be connected with a mating connector, i.e., a male connector, to electrically interconnect wiring harnesses. The dimensions of the housing 2 is determined to a large extent by the size and number of the terminals or poles.

The housing 11 is a single-piece component made of insulating material, such as plastic, using a molding method. The housing 11 may alternatively be formed using other known materials and methods. The housing 11 has a front receiving portion 11*a* at a front surface thereof, and a rear receiving portion 11*b* at a rear surface thereof. The front receiving portion 11*a* receives the TPA member 12 therein, and a plurality of terminal slots 19 corresponding to the number of the poles is configured accordingly. The TPA member 12 assures a proper position of the terminals of wiring harnesses 3 as described above. The plurality of terminal slots 19 on the front receiving portion 11*a* of the housing 11 are linked to a plurality of terminal slots on the rear receiving portion 11*b* through passageways within the housing 11 (not shown). The terminals disposed at ends of the wiring harnesses 3 are inserted in the terminal slots designed on the rear receiving portion 11*b* of the housing 11, while the TPA member 12 is fitted into the front receiving portion 11*a* of the housing, and whereby a female connector as a final product is configured. It is noted that FIG. 2 shows the configuration of the female connector 1 to which the TPA member 12 is already attached before inserting the wiring harnesses into the housing 11. Depending on a type of the connector 1, it is known that the connector 1 may be configured to accommodate the TPA member 12 from a side or bottom surface thereof.

The housing 11 is provided with a lever 14 that serves as an insertion assist mechanism doubling as connector locking mechanism. In this embodiment, the lever 14 is formed in a roughly inverted U-shape such that a beam 142 extending laterally is supported by two arms 141 at both side ends of the beam 142. A pair of pivotal protrusions 13 formed in a cylindrical shape is disposed on both sides of the housing 11. The two arms 141 are supported pivotally on the protrusions 13, and thereby the lever 14 is configured to move rotationally on the protrusions 13. Further, a stopper 20 having a tapered portion is disposed on one side surface of the housing 11. The stopper 20 may be in contact with an edge portion 14*a* of the lever 14, and thereby the lever 14 is preliminarily restrained at a pre-engagement position. The two stoppers 20 may be disposed on the both sides of the housing 11. The stopper 20 is configured to elastically move in a substantially normal direction to the side surface of the housing 11 in response to a predetermined external force. Thus, when a certain rotational force is applied to the lever in a direction shown by an arrow A, the stopper 20 is forced into the housing 11 because of interference with the edge portion 14*a*, the lever 14 becomes movable rotationally. The lever 14 is rotationally movable within a range between the pre-engagement position and a final engagement position that a lever locking portion 21 of the lever 14 as will be described below comes into engagement with an engagement portion 18.

The lever 14 also includes an arcuate recess 16 that is configured to fit a boss 15 of a mating connector 2 thereinto as shown in FIG. 1. Namely, the recess 16 serves as a cam groove. In the process of connecting the female connector 1 and the male connector 2, the boss 15 initially comes into contact with a guide portion 16*a* of the recess 16. Subsequently, by way of rotating movement of the lever 14 in a direction of the arrow A, the boss 15 is fitted into the recess 16, in response to a reactive force between the lever 14 and the boss 15 so as to connect the female connector 1 with the male connector 2. This insertion-assist mechanism allows an insertion force to be reduced in the process of the combining, and also allows the complementary connectors 1 and 2 to be reliably combined. The insertion-assist mechanism may be provided on both side surfaces of the housing.

FIGS. 5 through 9 illustrate a configuration of the lever 14 in detail. As discussed above, the lever 14 is formed in a roughly inversed U-shape in a manner in which the beam 142 cross-links the two arms 141. The lever 14 comprises a lever locking portion 17 in proximity of a middle, front of the beam 142. The lever locking portion 17 includes a base 171 like a button to receive a pressing operation by a user or assembler, a latching arm 172 extending forward from the base 171, and a latching detent 173 disposed on a free end of the latching arm 172 and extending upward. The latching detent 173 is configured to be flexibly movable, and thereby can engage with the engaging portion 18 of the housing 11. The latching detent 173 may have a tapered portion 173*a* so as to readily move downward, reducing an interference force with the engaging portion 18. The lever locking portion 17 also includes a reinforcing member 174 configured to cross-link the arms 141 so as to support the base 171. The lever 14 including the lever locking portion 17 may be formed in a single piece. The beam 142 includes a curved portion 142*a* formed in a manner in which the middle portion of the beam 142 is bowed rearward, thereby allowing a finger of the user to easily sit on a top surface of the base 171. Tread patterns may be formed on a front surface of the beam 142 to enhance operability.

Figure 10:
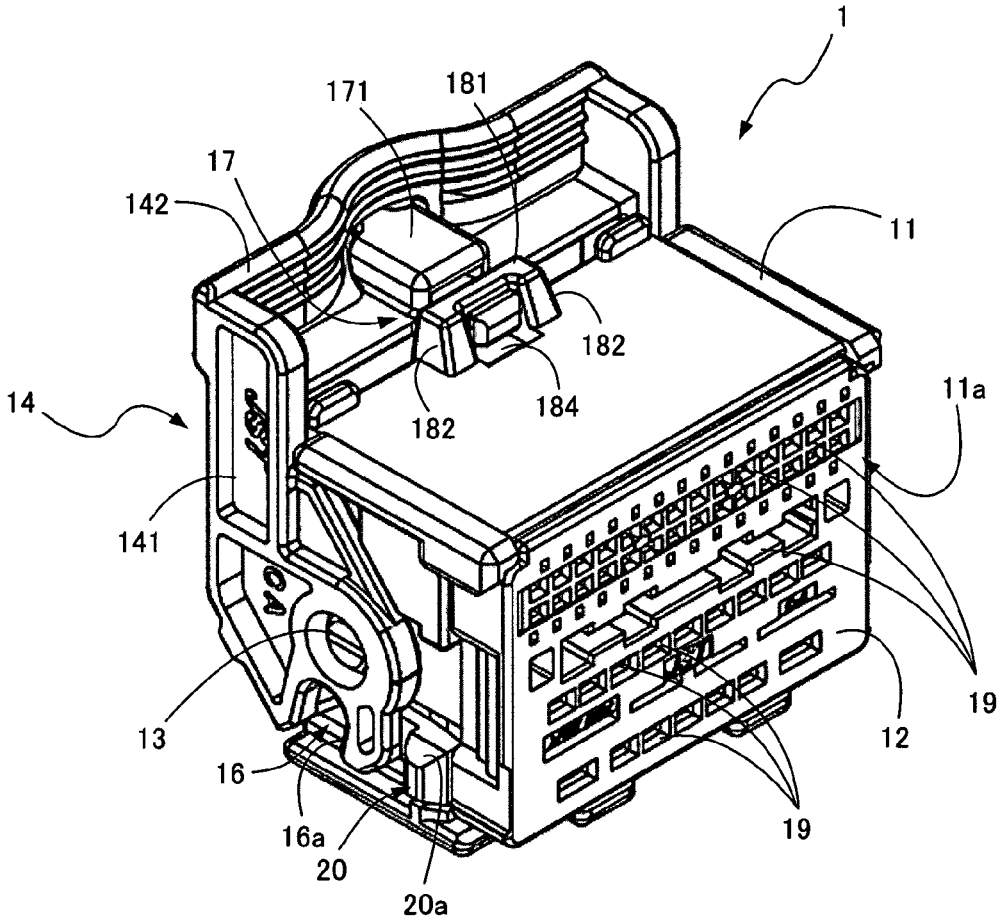
FIG. 10 illustrates a perspective view of the connector when the lever is positioned at a final engagement position according to an embodiment of the invention.

Referring to FIG. 2, the engagement portion 18, which engages with the latching detent 173, is disposed in proximity to a rear, top portion of the housing 11. The engaging portion 18 includes a shoulder portion 181 supported by raised portion 182 defining an aperture 183. The shoulder portion 181 includes an engagement surface 181*a* configured to engage with the latching detent 173 of the lever locking portion 17. A rear portion of the shoulder portion 181 may also be formed in a tapered shape to reduce the interference force with the latching detent 173. It should be understood that the shoulder portion 181 requires adequate strength because of interference and engagement with the latching detent 173. Thus, the shoulder portion 181 preferably has a sufficient thickness thereof, while it is necessary to define an aperture enough to penetrate the latching detent 173. Accordingly, a recess 184 may be formed in a top portion of the housing 11 facing the shoulder portion 181. By way of this, the aperture 183 in an adequate size is ensured in control of a height of the shoulder portion 181. As a result of the rotating movement of the lever 14, the latching detent 173, which is approaching the engagement portion 18 of the housing 11, moves downward and passes under the shoulder portion 181 due to interference with a tapered portion of the engagement portion 18. Thereafter, the latching detent 173 snaps back to engage with the engagement surface 181*a*. Thus, the rotational movement of the lever 14 is properly restrained at the final engagement position. FIG. 10 shows that the lever 18, which is positioned at the final engagement position, engages with the engagement portion 18. By virtue of this configuration, during the process of connecting with the mating connector 2, the fit of the boss 15 into the recess 16 is maintained. As a consequence, the connection between the complementary connectors 1 and 2 is reliably assured.

When the lever 14 at the final engagement position gets back to the pre-engagement position, disengagement of the lever locking portion 17 with the engaging portion is necessary for rotating movement of the lever 14. Specifically, a downward force is applied to the top surface of the base 171 to disengage the latching detent 173 and the shoulder portion 181, and thereby the lever 14 can be rotated toward the pre-engagement position.

Figure 11A:
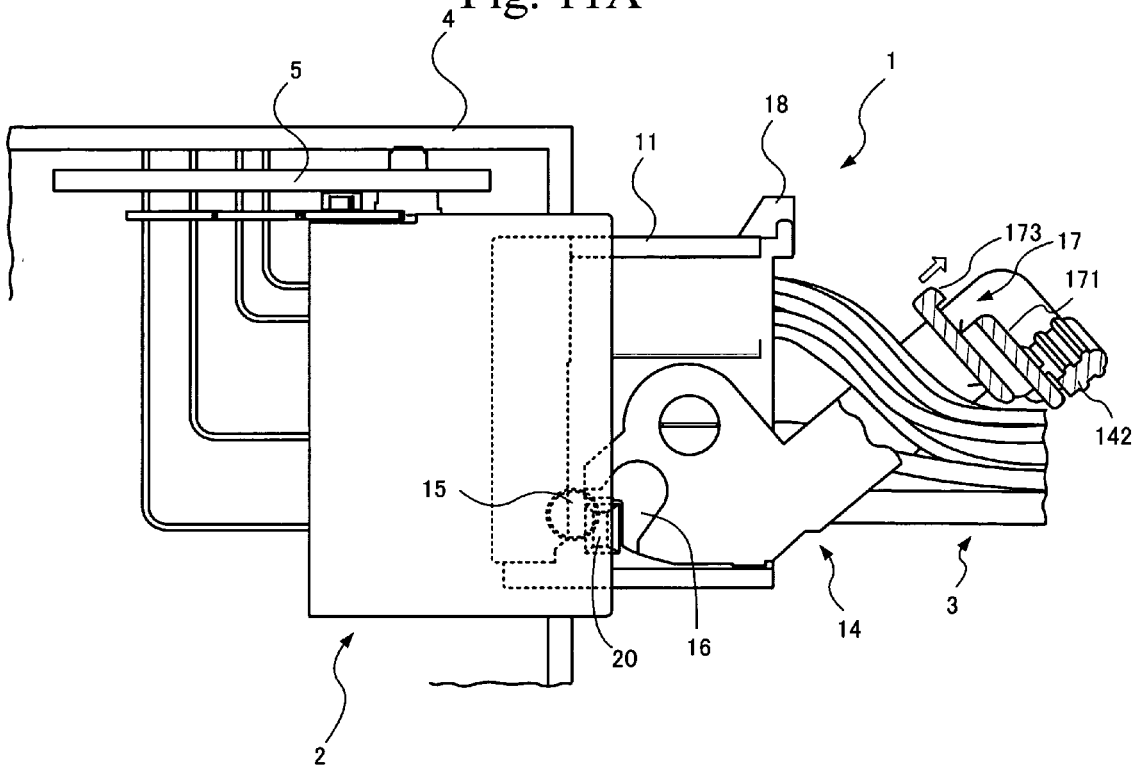
FIG. 11A is a diagram showing interference of a lever locking portion of the connector with wiring harnesses according to an embodiment of the present invention.
Figure 11B:
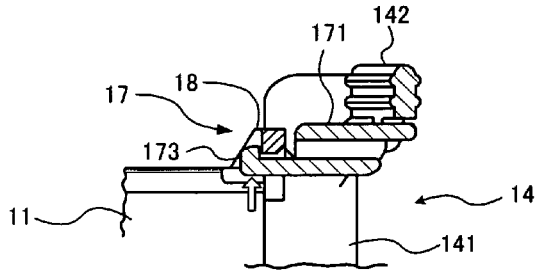
FIG. 11B illustrates an engaged state of the lever locking portion with an engaging portion of the housing.
Figure 12:
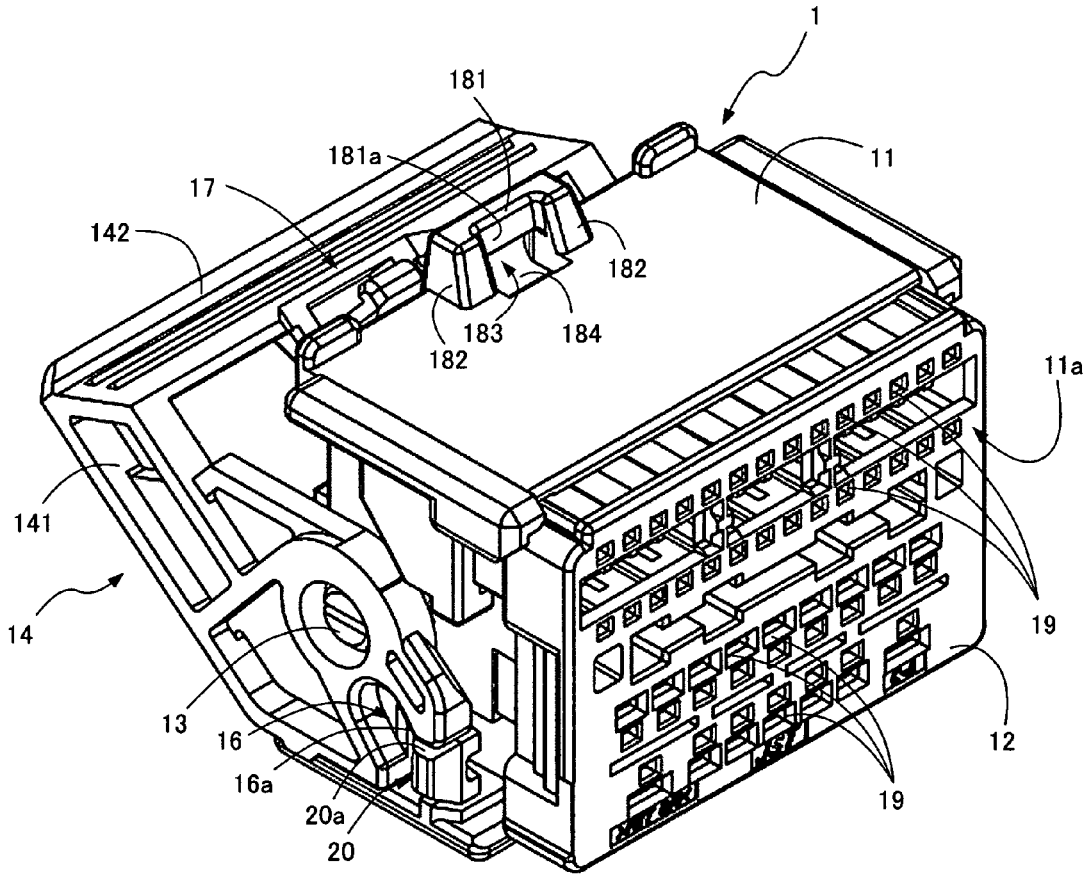
FIG. 12 illustrates a perspective view of a connector with a lever when the lever is positioned at a pre-engagement position according to an embodiment of the invention.
Figure 13:
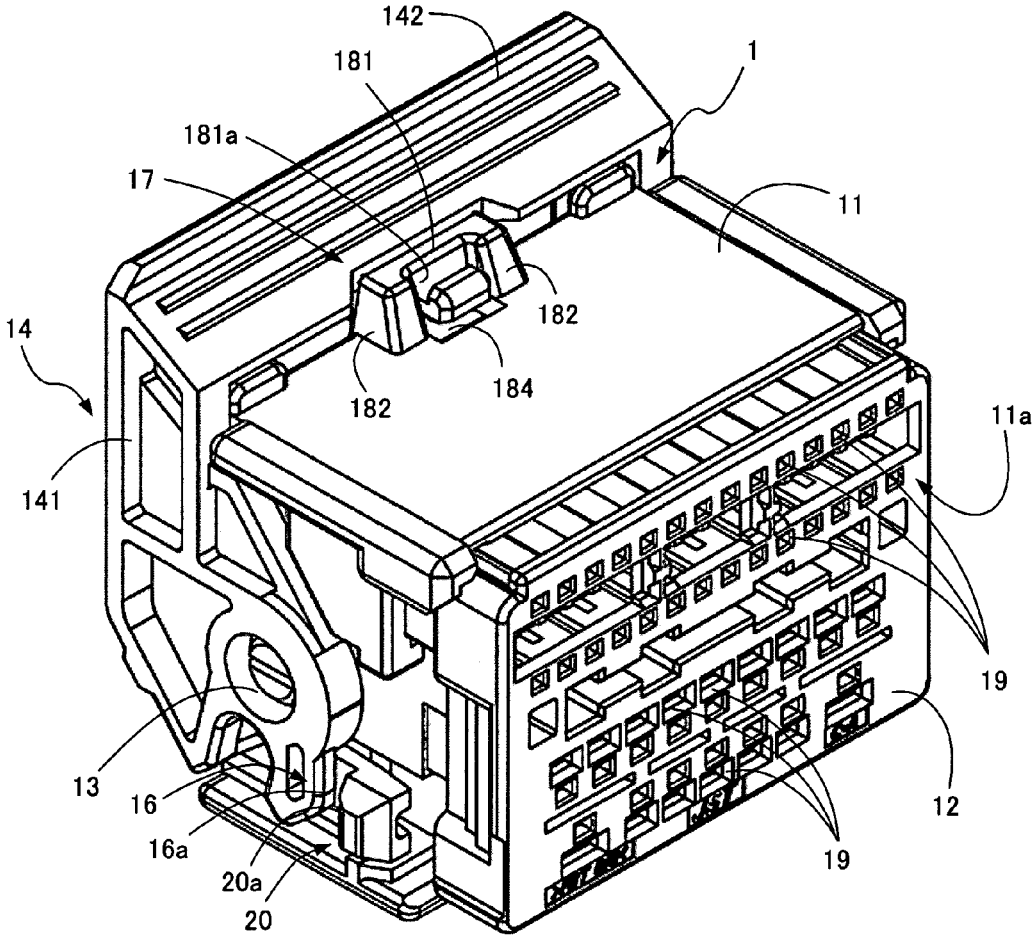
FIG. 13 illustrates a perspective view of the connector when the lever is positioned at a final engagement position according to an embodiment of the invention.
Figure 14:
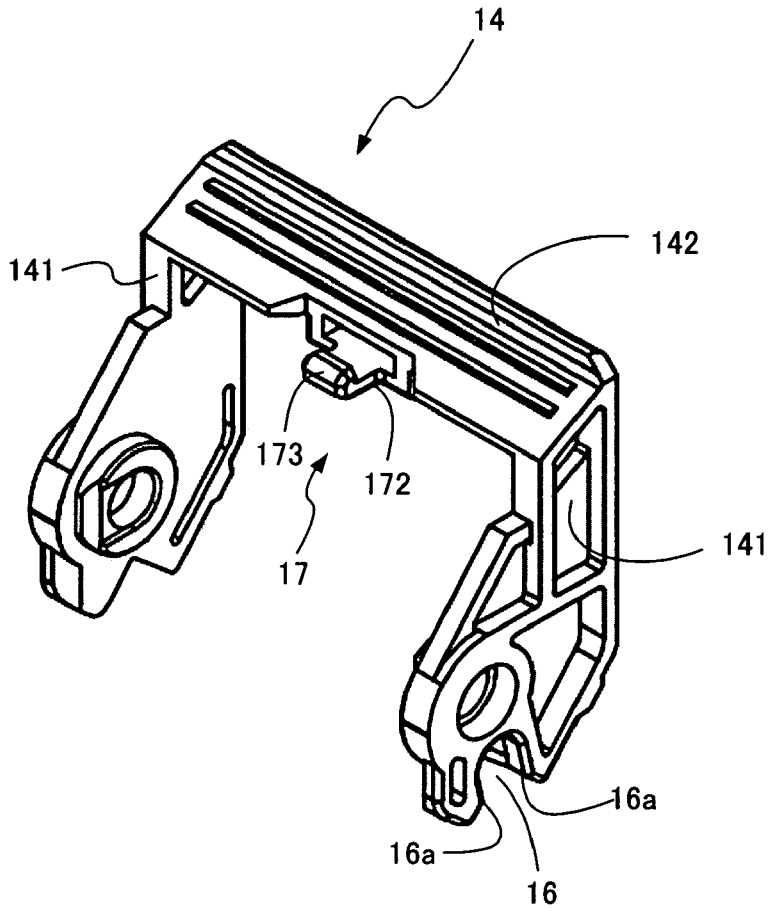
FIG. 14 illustrates a perspective view of a lever of the connector according to an embodiment of the invention.
Figure 15:
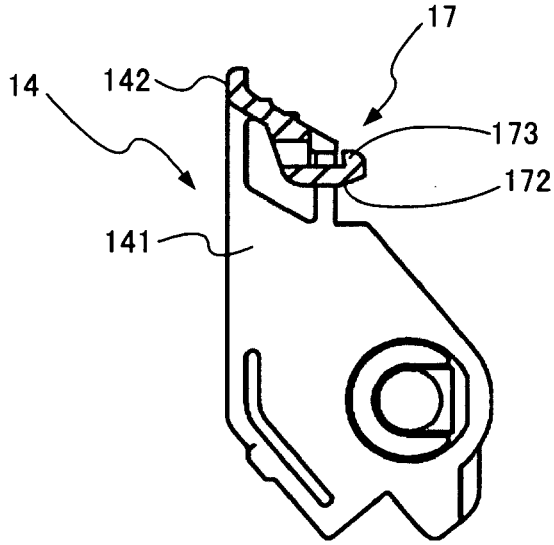
FIG. 15 illustrates a cross-sectional view of the lever show in FIG. 14.

The connector 1 discussed above is intended to be connected with the mating connector 2 after the wiring harnesses 3 is inserted into the connector 1. Prior to such connection with the mating connector 2, the lever 14 of the connector 1 is held at the pre-engagement position. At this point, as shown in FIG. 11A, a bottom portion of the lever locking portion 17 may be subjected to the attached wiring harnesses 3 extending backward from the rear portion 11*b* of the housing 11. In the configuration of the lever locking portion 17, the latching arm 172 extends forward from the base 171, and also a rear portion of the lever locking portion 17, which may be subjected to undesired interference with the attached wiring harnesses 3, is reinforced with the reinforcing member 174. Thus, the performance of the lever locking portion 17 can be reliably maintained. This way, even if the latching detent 173 interferes with the wiring harnesses 3, the latching detent 173 is moved upward. In other words, as is apparent from FIG. 11A, the deformation of the latching detent 213, at the final engagement position, allows the engagement with the engagement surface 181*a* of the engagement portion 18 to become deeper. According to this embodiment, even if the lever locking portion 17 becomes deformed due to the interference with the wiring harnesses 3 for prolong periods of time, the deformation is in a direction such that increases engagement between the latching detent 173 and the engagement portion 18. Advantageously, the engagement of the lever locking portion 17 with the engagement portion 18 is reliably assured, preventing unintentional separation of the connectors.

FIGS. 12 through 15 illustrate an electrical connector according to another embodiment of the present invention. As is apparent from these figures, a connector 1 of this embodiment is different in a shape of the lever 14 from the connector 1 as discussed above.

Specifically, a beam 142 of a lever 14 is formed in a plate-like member, which gently slopes upward and away from the front. A top surface of the beam 142 may have tread patterns. A lever locking portion 17 is disposed in proximity of a middle portion of the beam 142. As shown in a cross section of FIG. 15, the lever locking portion 17 includes a latching arm 172 extending forward from a bottom portion of the beam 142 and a latching detent 173 disposed on a free end of the latching arm 171 and extending upward.

In accordance with the rotational movement of the lever 14, the latching detent 173, which is approaching the engagement portion 18 of the housing 11, moves downward and passes under the shoulder portion 181 due to interference with a tapered portion of the engagement portion 18. Thereafter, the latching detent 213 snaps back to engage with the engagement surface 181*a*. Thus, the rotational movement of the lever 14 is restrained at the final engagement position. By virtue of this configuration, during the process of connecting with the mating connector 2, the fit of the boss 15 into the recess 16 is maintained. As a consequence, the connection between the complementary connectors 1 and 2 is reliably assured.

When the lever 14 at the final engagement position gets back to the pre-engagement position, an external force is applied to a portion of the beam 142 in proximity of the lever locking portion 17. Thus, the latching detent 173 of the lever locking portion 17 disengages with the engaging portion 18, thereby allowing the lever 14 to be rotated toward the pre-engagement position.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector comprising:

a housing;

at least one pivot disposed on the housing;

a lever having a beam and configured to rotate on the pivot within a range from a first position to a second position, wherein the lever has a recess configured to fit a boss disposed on a mating connector therein in accordance with rotational movement of the lever;

a engaging portion disposed on the housing; and a locking portion disposed on the beam, wherein the locking portion comprises:

a latching arm operatively connected to the beam and extending in a direction substantially tangent to the rotational movement; and a latching detent disposed in proximity of a free end of the latching arm, wherein the latching detent is configured to engage with the engaging portion at the second position, wherein the locking portion further comprises a base portion supporting the latching arm, wherein a top surface of the base portion is substantially flat, and wherein the beam has a curved portion such that a rear portion of the base portion is connected to the curved portion.

2. The connector according to claim 1, wherein the engaging portion is disposed at a rear, top portion of the housing.

3. The connector according to claim 1, wherein the locking portion is positioned in proximity of a middle portion of the beam.

4. The connector according to claim 1, wherein the latching detent extends upward from the free end of the latching arm.

5. The connector according to claim 1, wherein the engaging portion comprises a shoulder portion defining an aperture to pass the latching detent of the locking portion therethrough.

6. The connector according to claim 5, wherein the shoulder portion comprises an engagement surface configured to engage with the latching detent that passes though the aperture.

7. The connector according to claim 1, further comprising a plurality of wiring harnesses inserted into the housing from a rear portion of the housing.

8. The connector according to claim 1, wherein the lever has at least two arm portions to support the beam on both sides of the beam, wherein the two arm portions are supported pivotally by at least the two pivots disposed on both side surfaces of the housing.

9. The connector according to claim 1, further comprising a stopper disposed on the housing and configured to stop the lever at the first position, wherein the stopper releases the lever by the rotational movement of the lever.

10. A connector set comprising:

a first connector, wherein the first connector comprises:

a first housing; and a boss disposed on the first housing; and a second connector, wherein the second connector comprises:

a second housing to fit into the first housing;

at least one pivot disposed on the second housing;

a lever having a beam and configured to rotate on the pivot within a range from a first position to a second position, wherein the lever has a recess configured to fit the boss, disposed on the first connector therein in accordance with rotational movement of the lever;

a locking portion disposed on the beam, wherein the locking portion comprises:

a latching arm operatively connected to the beam and extending in a direction substantially tangent to the rotational movement; and a latching detent disposed in proximity of a free end of the latching arm, wherein the latching detent is configured to engage wit the engaging portion at the second position, wherein the locking portion further comprises a base portion supporting the latching arm, wherein a top surface of the base portion is substantially flat, and wherein the beam has a curved portion such that a rear portion of the base portion is connected to the curved portion.

11. The connector according to claim 10, wherein an engaging portion is disposed at a rear, top portion of the second housing.

12. The connector according to claim 10, wherein the locking portion is positioned in proximity of a middle portion of the beam.

13. The connector according to claim 10, wherein the latching detent extends upward from the free end of the latching arm.

14. The connector according to claim 11, wherein the engaging portion comprises a shoulder portion defining an aperture to pass the latching detent of the locking portion therethrough.

15. The connector according to claim 14, wherein the shoulder portion comprises an engagement surface configured to engage with the latching detent that passes through the aperture.

16. The connector according to claim 10, further comprising a plurality of wiring harnesses inserted into the second housing from a rear portion of the second housing.

17. The connector according to claim 10, wherein the lever has at least two arm portions to support the beam on both sides of the beam, wherein the two arm portions are supported pivotally by at least the two pivots disposed on both side surfaces of the second housing.

18. The connector according to claim 10, further comprising a stopper disposed on the second housing and configured to stop the lever at the first position, wherein the stopper releases the lever by the rotational movement of the lever.

* * * * *

UNITED STATES PATENT AND TRADEMARK OFFICE

CERTIFICATE OF CORRECTION

PATENT NO. : 7,396,240 B2
APPLICATION NO. : 11/398480
DATED : July 8, 2008
INVENTOR(S) : Stephen S. Frederiksen et al.

It is certified that error appears in the above-identified patent and that said Letters Patent is hereby corrected as shown below:

In Claim 6, column 17, line 12, the word "though" should be --through--.

In Claim 10, column 8, line 3, the word "wit" should be --with--.

Signed and Sealed this

Twenty-seventh Day of January, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,396,240 B2
APPLICATION NO. : 11/398480
DATED : July 8, 2008
INVENTOR(S) : Stephen S. Frederiksen et al.

It is certified that error appears in the above-identified patent and that said Letters Patent is hereby corrected as shown below:

In Claim 6, column 7, line 12, the word "though" should be --through--.

In Claim 10, column 8, line 3, the word "wit" should be --with--.

This certificate supersedes the Certificate of Correction issued January 27, 2009.

Signed and Sealed this

Seventeenth Day of February, 2009

John Doll

JOHN DOLL
*Acting Director of the United States Patent and Trademark Office*